US009725658B2

(12) United States Patent
Wang et al.

(10) Patent No.: US 9,725,658 B2
(45) Date of Patent: Aug. 8, 2017

(54) METHOD OF PROCESSING LOW-GRADE HEAVY OIL

(71) Applicants: CHINA UNIVERSITY OF PETROLEUM-BEIJING, Beijing (CN); CHINA NATIONAL PETROLEUM CORPORATION, Beijing (CN)

(72) Inventors: Gang Wang, Beijing (CN); Jinsen Gao, Beijing (CN); Chunming Xu, Beijing (CN); Baojian Shen, Beijing (CN); Hongliang Wang, Beijing (CN)

(73) Assignees: CHINA UNIVERSITY OF PETROLEUM-BEIJING, Beijing (CN); CHINA NATIONAL PETROLEUM CORPORATION, Beijing (CN)

( * ) Notice: Subject to any disclaimer, the term of this patent is extended or adjusted under 35 U.S.C. 154(b) by 344 days.

(21) Appl. No.: 14/296,387

(22) Filed: Jun. 4, 2014

(65) Prior Publication Data

US 2015/0090637 A1 Apr. 2, 2015

(30) Foreign Application Priority Data

Sep. 29, 2013 (CN) ..... 2013 1 0455197

(51) Int. Cl.

*C10G 11/18* (2006.01)
*C10G 11/02* (2006.01)
*C10G 11/04* (2006.01)

(52) U.S. Cl.

CPC ..... *C10G 11/18* (2013.01); *C10G 11/02* (2013.01); *C10G 11/04* (2013.01);
(Continued)

(58) Field of Classification Search

CPC ..... C10G 11/02; C10G 11/14; C10G 11/18; C10G 11/182; C10G 11/185; B01J 35/00; B01J 35/002

See application file for complete search history.

(56) References Cited

U.S. PATENT DOCUMENTS 3,144,400 A 8/1964 Weinberg et al. ..... 208/81
4,243,514 A 1/1981 Bartholic ..... 208/91
(Continued)

FOREIGN PATENT DOCUMENTS

CN 1749361 A 3/2006
CN ZL200310110205.7 6/2006
(Continued)

OTHER PUBLICATIONS

Parkash, S, Refining Processes Handbook, 2003, Gulf Publishing, pp. 109-152.*
(Continued)

*Primary Examiner* — Renee Robinson
*Assistant Examiner* — Derek Mueller
(74) *Attorney, Agent, or Firm* — J.C. Patents

(57) ABSTRACT

The present invention provides a method for processing low-grade heavy oil, comprising: providing a riser-bed reactor; preheating the low-grade heavy oil and injecting it into the riser reactor to react with solid catalyst particles at the temperature of 550-610° C.; oil-gas, after reacting with the solid catalyst particles in the riser reactor, being introduced into the fluidized bed reactor to continue to react at temperature of 440-520° C. and weight hourly space velocity of 0.5-5 $h^{-1}$; and the oil-gas, after reacting in the fluidized bed reactor, being separated from coked solid catalyst particles carried therein, and the separated oil-gas being introduced into a fractionation system. The method can effectively remove carbon residues, heavy metals, asphaltenes and other
(Continued)

impurities from the low-grade heavy oil, and obtain high liquid product yield in a simple process.

14 Claims, 2 Drawing Sheets

(52) U.S. Cl.
CPC ..... *C10G 2300/107* (2013.01); *C10G 2300/1077* (2013.01); *C10G 2400/02* (2013.01); *C10G 2400/04* (2013.01); *C10G 2400/30* (2013.01)

(56) References Cited

U.S. PATENT DOCUMENTS

| | | | | | |
|---|---|---|---|---|---|
| 4,298,459 | A * | 11/1981 | Tatterson | C10G 11/18 208/113 |
| 5,393,412 | A * | 2/1995 | Hettinger | C10G 11/182 208/113 |
| 7,678,342 | B1 | 3/2010 | Xu et al. | 422/139 |

FOREIGN PATENT DOCUMENTS

| | | | |
|---|---|---|---|
| CN | 1854258 | A | 11/2006 |
| CN | 101259398 | A | 9/2008 |
| CN | 102051213 | A | 5/2011 |
| CN | 102102026 | A | 6/2011 |
| CN | 102234531 | A | 11/2011 |
| CN | 202898341 | A | 4/2013 |
| CN | 103509596 | A | 1/2014 |
| WO | WO 2012004805 | A1 | 1/2012 |

OTHER PUBLICATIONS

CN202898341—Translation into English.*
CN1854258—Translation into English.*
Chinese International Search Report and Written Opinion of corresponding International PCT application No. PCT/CN2014/079081, dated Sep. 5, 2014.
Chinese First Examination Report of corresponding China patent application No. 201310455197.3, dated Sep. 30, 2014.
The Canadian Official Examination Report of corresponding Canada patent application No. 2,888,003, dated Mar. 29, 2016.

* cited by examiner

METHOD OF PROCESSING LOW-GRADE HEAVY OIL

CROSS-REFERENCE TO RELATED APPLICATIONS

This application claims priority to Chinese Patent Application No. 201310455197.3, filed on Sep. 29, 2013, entitled "Method for Processing Low-grade Heavy Oil", which is incorporated herein by reference in its entirety.

FIELD OF THE TECHNOLOGY

The present invention relates to a method for processing low-grade heavy oil, belonging to the technical field of petrochemicals.

BACKGROUND

In the oil refining industry, low-grade heavy oil generally refers to a heavy oil fraction with high boiling point, high carbon residue, high metal content and high asphaltene content, the types of low-grade heavy oil generally include vacuum residue, heavy oil residue from solvent separation process, de-oiled asphalt and oil sand bitumen, etc. Low-grade heavy oil has lower commercial value, because on one hand it cannot be used directly as fuel oil under the limitation of environmental regulations due to its own nature, and on the other hand it can easily result in permanent deactivation of catalyst and coking fault of the device due to high asphaltene content, heavy metal content and carbon residue value and, thus, cannot be used as feedstock for conventional catalytic cracking, hydrotreating process and delayed coking process. For example, fixed bed hydrotreating process generally cannot handle the heavy oil having a total content of heavy metals Ni and V of greater than 150 $\mu g \cdot g^{-1}$ and a carbon residue value of greater than 15 wt %, while most low-grade heavy oil have much higher heavy metal content and carbon residue value (which can be considered to be a lower-grade ultra heavy oil having index much higher than that of a low-grade heavy oil and have much deteriorated nature); in delayed coking process, the use of the low-grade heavy oil will cause the radiant tubes of heating furnace easier to coke, which may cause the device not to operate normally.

Therefore, in oil refining industry, there is a need to provide a method for processing low-grade heavy oil, especially for processing a lower-grade ultra heavy oil, to effectively promote removals of carbon residue, heavy metal and asphaltene from the low-grade heavy oil as well as maintaining high liquid product yield, lower gas yield and coke yield, thereby providing more valuable and relatively cleaner feedstock with high hydrogen content for downstream processes.

For the processing of low-grade heavy oil, there have been disclosed some improved technical solutions. For example, U.S. Pat. No. 3,144,400A discloses a fluidized coking process for continuous production of low-grade heavy oil. In this process, a preheated low-grade heavy oil is injected into a reactor via a nozzle, a fluidized bed formed by hot coke powder particles is provided in the reactor, the low-grade heavy oil forms a thin layer on the surface of the coke powder particles after being injected into the reactor, which is heated for coking reaction. In the reactor, the temperature is controlled in a range of 480-560° C. with the pressure slightly higher than the atmospheric pressure. The coke powder particles are fluidized by means o oil-gas and water vapor entered from the bottom of the reactor. The oil-gas generated is outputted from the top of the reactor into the scrubber and the fractionation column after separating coke powder particles via a cyclone separator. In the scrubber, low-grade heavy oil is used to elute the coke powder particles carried by the oil-gas. The slurry-like liquid is returned to the fluidized reactor as circulating oil, and part of coke, after stripping out oil-gas carried therein by water vapor, enters into a coke-burning device for regenerating. The coke-burning device is essentially a fluidized bed combustion reactor, from the bottom of which, air is introduced to partially burn the coke particles, thereby maintaining the fluidized bed at a temperature of 590-650° C. Regenerated high-temperature coke particles are recycled into the reactor, acting as a heat carrier for preheating raw oil and supplying required reaction heat.

In the above fluidized coking process, since coking reaction of the heavy oil will produce coke and diameters of the coke particles already existing in the reactor will increase with the progress of the reaction, large-size coke particles that are not suitable for fluidizing need to be removed in time to maintain the reaction environment, which naturally increases the difficulty of the process; in addition, as fluidized media, coke particles have low strength and are easy to be crushed, which will affect effects of the fluid coking reaction, and in this case, they are also used as catalyst, which will make poor effects of removing residual carbon, asphaltene and metal impurities, obtaining oil with poor quality. For example, middle distillate oil obtained by fluidized coking process of low-grade heavy oils has high basic nitrogen compound content, unfavourable to further catalytic process and use; the obtained coking gasoline has serious problems of low octane value and high sulfur and nitrogen contents, bringing a lot of obstacles for subsequent modification and refinement.

Referencing to fluidized coking process technology, an upgrading technique of using cheaper, inert, solid catalytic microsphere particles instead of coke particles for removing carbon, heavy metal and asphaltene from heavy oil has been proposed. For example, U.S. Pat. No. 4,243,514 discloses a heavy oil upgrading process, which is called ART process, in which the heavy oil is in short-time contact with a fluidized high-temperature inert catalyst in a riser after being preheated, gasifying light components in the heavy oil, and macromolecular compounds containing heteroatoms of metal, sulfur and nitrogen, such as asphaltene, are deposited on the contacted particles, producing vaporizable small molecules and coke via cracking and condensation reactions. The oil-gas is rapidly cooled at the outlet, and the solid contacting catalyst for depositing coke is transferred to a regenerator for regenerating. The process and apparatus for this process are similar to those of FCC process, except for the raw material to be processed and the contacting catalyst. The actual application results show that the process has certain effect for upgrading heavy oil having relatively low residual carbon and heavy metal content, but fails to achieve the desired effect for the low-grade heavy oil.

CN 200310110205.7 discloses a combined process for processing heavy oil, in which the hydrogenation and decarbonization technologies are integrated by a combination of ROP, RHT and RFCC processes to treat low-grade residual oil. In this process, fluidization-to-decarbonization process for treating residual oil uses an inert porous microspherical heat carrier as a catalyst, to contact and react with the residual oil in a riser reactor, the components containing relatively more hydrogen being rapidly gasified after contacting with the heat carrier, while high-boiling components containing carbon residue are not easy to be gasified, so they are cracked, the coke thus obtained by condensation is deposited on the contacting catalyst, as well as the metal impurities and some sulfur and nitrogen elements in the residual oil, separate the contacting catalyst from the reacted oil-gas and strip the catalyst, the stripped contacting catalyst is transferred to a regenerator to regenerate for recycling. The inert porous microspherical heat carrier used in the process can remove carbon residue, asphaltene and metal impurities and can process low-grade heavy oil having high residual carbon content and high density (such as Iran vacuum residual oil), but the product obtained has poor distribution and low yields of gasoline, diesel oil and total liquid products. Thus, follow-up process such as residue hydrotreating (RHT) and residue fluidized catalytic cracking (RFCC) is needed in order to meet the processing requirements for low-grade residual oil In summary, there is a need to provide a method which can process low-grade heavy oils in a convenient and effective manner, obtain liquid products with higher yields, and provide more and lighter hydrocarbon materials for downstream processes.

SUMMARY

The present invention provides a method for processing low-grade heavy oil, which can effectively remove carbon residues, heavy metals, asphaltenes and other impurities, and obtain liquid product with high yield in a simple process.

The present invention provides a method for processing low-grade heavy oil, including the steps of:

providing a riser-bed reactor including a riser reactor and a fluidized bed reactor connected in series with the riser reactor;

preheating the low-grade heavy oil and injecting the preheated low-grade heavy oil into the riser reactor to contact and react with solid catalyst particles in the riser reactor, wherein reaction temperature in the riser reactor is controlled to be in the range of 550-610° C.;

oil-gas, after undergoing the reaction with the solid catalyst particles in the riser reactor, being introduced from the riser reactor into the fluidized bed reactor to continue to react in the fluidized bed reactor, wherein reaction temperature in a bed layer of the fluidized bed reactor is 440-520° C. and weight hourly space velocity is 0.5-5 $h^{-1}$; and the oil-gas, after undergoing the reaction in the fluidized bed reactor, being separated from coked solid catalyst particles carried therein, and the separated oil-gas being introduced into a fractionation system;

wherein the solid catalyst particles have a specific surface area of greater than 80 $m^2 \cdot g^{-1}$, a pore volume of greater than 0.22 ml/g, a wear index of less than 2.0% and a micro-activity index of 20-50.

The method provided in the present invention has more remarkable advantages when it is used to process heavy oil having carbon residue content of greater than 15 wt %, heavy metal content of greater than 260 ng/g and relative density of more than 0.985.

The implementation of the present invention at least has the following advantages:

1. the product obtained according to the method of the present invention for processing low-grade heavy oil can achieve excellent removal rate of heavy metal, asphaltene and carbon residue;

2. higher liquid yield and lower gas and coke yield can be obtained in processing low-grade heavy oil;

3. the method of the present invention can obtain a gasoline fraction having a high octane value and low sulfur and nitrogen contents, and a wax oil having low basic nitrogen compound content, providing more lighter feedstock for downstream processes; and 4. the method of the present invention can effectively process low-grade heavy oil in a one-step process, which is a simple process and is advantageous for industrial application.

DETAILED DESCRIPTION

Figure 1:
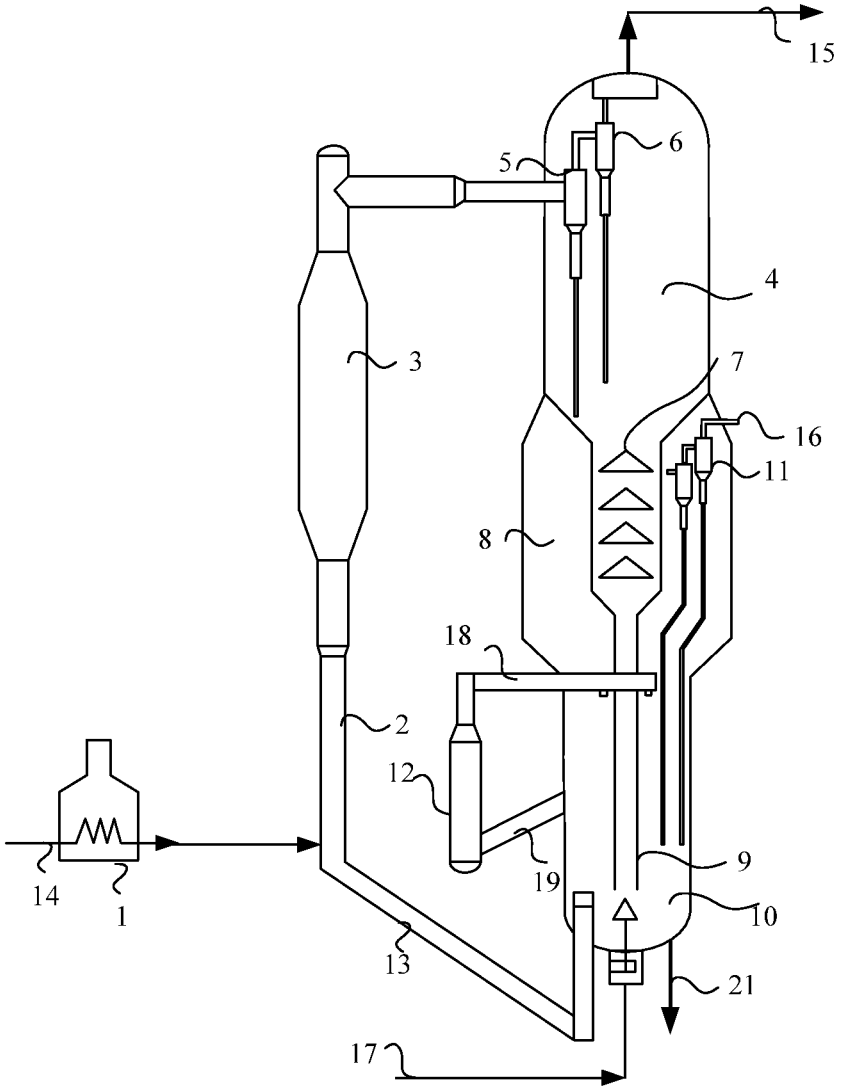
FIGS. 1 and 2 are schematic diagrams showing the method for processing low-grade heavy oil according to embodiments of the present invention, respectively.

In a low-grade heavy oil, carbon residue is mainly produced by condensation reaction of fused ring compounds with high boiling points, such as gum and asphaltene; and heavy metal mainly exists in macromolecular heterocyclic compounds such as gum and asphaltene; the gum and asphaltene each has a boiling point of greater than 500° C. and is difficult to be gasified, and thus is mainly present in liquid phase under reaction conditions. The studies by the present inventor have demonstrated that the use of solid catalyst particles with larger specific surface area and pore volume can effectively remove impurities such as carbon residue, heavy metal and asphaltene during the process. The solid catalyst particles with larger specific surface area and pore volume can effectively capture the non-gasified low-grade heavy oil droplets having components such as gum and asphaltene, making the droplets spread and disperse well on surfaces of porous passages and being favorable for stripping of heavy metal, carbon and reaction products; meanwhile the above solid catalytic particles also have good flow properties and mechanical strength to meet requirements for fluidized reaction for processing the low-grade heavy oil. In addition, the solid catalyst particles should also have a suitable micro-activity, with the micro-activity index in the range of 20-50, preferably 20-40, and in a particular embodiment, e.g., the solid catalyst particles with a micro-activity index of about 25 can be selected. The solid catalyst particles having a suitable micro-activity index can quickly initiate a cracking reaction of the low-grade heavy oil, avoiding the low-grade heavy oil to be converted into a coke precursor (i.e., Conradson carbon residue), thereby reducing the generation of coke, and also can absorb basic nitrogen compounds, and removing it from the low-grade heavy oil.

The method of the present invention can select porous microsphere particles having the above properties as the solid catalyst particles, a porous material with alumina and silica as main components is commonly used. According to the method of the present invention, the solid catalyst particles may further be selected as a porous material with a bulk density of 0.7-1.50 $g/cm^3$ and a matrix density of 1.8-2.8 $g/cm^3$, and the pores with a diameter of 10 nm or more account for 60% or more in the pore size distribution of the porous material. Selecting the bulk density and the matrix density indicated above is helpful to improve fluidization performance and mechanical strength of the solid catalyst particles and selecting the pore size distribution indicated above is helpful to obtain porous catalyst particles having a larger diameter, thereby capturing non-gasified low-grade heavy oil droplets more effectively to better meet the requirements for processing a low-grade heavy oil.

The present invention uses a riser-bed reactor or an assembly of a riser reactor and a fluidized bed reactor to process low-grade heavy oil, which increases the density of the solid catalyst particles per volume in the riser reactor, and is favorable for more sufficient contact of the solid catalyst particles with difficult-to-vaporize components such as gum and asphaltene of the low-grade heavy oil feedstock, thereby achieving efficient dispersion and gasification of the low-grade heavy oil feedstock and increasing reaction efficiency. The riser-bed reactor may include a riser reactor and a fluidized bed reactor, the fluidized bed reactor is connected in series with the riser reactor downstream of the riser reactor, with the inner diameter or lateral dimension of the fluidized bed reactor being larger than that of the riser reactor. The riser-bed reactor also can be integrally made, including a riser section and a bed section arranged in series with the riser section, with the inner diameter or lateral dimension of the bed section being larger than that of the riser section. In an embodiment, the ratio between the diameter of the fluidized bed reactor or bed section and the diameter of the riser reactor or riser section is selected to form a fluidized bed layer in the fluidized bed reactor or bed section under reaction conditions. In the riser reactor, the low-grade heavy oil feedstock and the solid catalyst particles contact at high temperature and adequately mix together, a cracking reaction takes place quickly within a short time when the low-grade heavy oil passing through the riser reactor, the light fractions generated by the cracking reaction, due to their small molecules and weak polarity, can quickly pass through the fluidized bed reactor (when the solid catalyst particles enter the bed layer of the fluidized bed reactor, since the fluidized bed reactor has a greater diameter than that of the riser reactor, the gas linear velocity reduces, thus the solid catalyst particles form a bed layer), and enter subsequent fractionation system; the heavy oil molecules that are not sufficiently reacted, due to their large molecules and strong polarity, are adsorbed onto the solid catalyst particles in the fluidized bed reactor to be further converted.

In the present invention, the fluidized bed reactor may be selected to have relatively mild reaction conditions, the reaction temperature may be less than 550° C. and in coordination with an adjustment of the weight hourly space velocity. For example, in an embodiment, a reaction temperature of 440-520° C. and a weight hourly space velocity of 0.5-5 $h^{-1}$ are adapted, it is advantageous for the bed layer formed by the solid catalyst particles to control cracking reaction depth of the low-grade heavy oil, reduce gas production rate, and obtain a higher yield of liquid products.

The method of the present invention can process the following low-grade heavy oil, for example, vacuum residue, heavy oil residue from solvent separation process, de-oiled asphalt, oil sand bitumen, tar, shale oil or coal liquefaction residual oil, and is particularly suitable for treatment of lower-grade ultra heavy oil. In a particular embodiment, the low-grade heavy oil feedstock is a heavy oil having carbon residue content of more than 15 wt %, heavy metal content of greater than 260 ng/g and relative density of greater than 0.985, which is preheated to 220-300° C. before and then injected into the riser reactor.

In the process, as the low-grade heavy oil feedstock has high C/H ratio, i.e., having excess carbon, high concentration of coke will deposit on the solid catalyst particles after the low-grade heavy oil feedstock contacts and reacts with solid catalyst particles, that is, surfaces of the solid catalyst particles acting as a contacting catalyst will be coked, and the coked solid catalyst particles will enter the next process along with the oil-gas formed in the reaction. Therefore, the coked solid catalyst particles and the oil-gas need to be separated and the coked solid catalyst particles may be regenerated for recycling. According to the method of the present invention, the coked solid catalyst particles separated from the oil-gas enter a regenerator for regeneration after being stripped by superheated steam, and then are recycled back to the riser-bed reactor. In the present invention, high-temperature solid catalyst particles with coked surfaces are called as spent catalyst, which may be reused after regenerated in the regenerator. In order to distinguish from fresh solid catalyst particles (i.e., solid catalyst particles used for the first time), the regenerated solid catalyst particles for recycling are called as regenerated catalyst in the present invention. Method for regenerating coked solid catalyst particles may be coke-burning regeneration, i.e., feeding air to burn the coke into carbon dioxide (typically can be completed at 670-700° C.), or gasifying regeneration, i.e., at a high temperature (e.g., 700-750° C.), feeding oxygen and water vapor into the bottom of a regenerator respectively, where the oxygen functions to partially burn the coke and increase the temperature, and then the water vapor reacts with the remaining coke, to convert the coke on the solid catalyst particles into CO and $H_2$, thereby restoring reactivity of the solid catalyst particles.

In an embodiment of the present invention, the coked solid catalyst particles, after undergoing regeneration treatment, enter a heat extractor to conduct a heat exchange, and then are recycled back to the riser reactor at the bottom thereof. The temperature of the solid catalyst particles recycled back to the riser reactor is in the range of 670-750° C. (670-700° C. for coke burning regeneration, and 700-750° C. for gasifying regeneration).

The regeneration of the solid catalyst particles is an exothermic process, and the heat generated can be carried back to the reactor via the regenerated catalyst, to provide the heat needed for the reaction, but this part of heat is usually in excess, and especially in the process of processing low-grade heavy oil having high coke formation yield, the coke is formed at a high yield, which makes the surplus heat in the regenerator even more obvious, or rather in serious excess of heat. According to the process of the present invention, the surplus heat in the regenerator can be adjusted by providing a heat extractor, which can balance the heat carried back to the reactor by the regenerated catalyst and the heat needed in reaction, thereby advantageously maintaining heat balance of reactor-regenerator system and meanwhile advantageously controlling reaction temperature (550-610° C.) under conditions of high catalyst-to-oil ratio.

The heat extractor can be disposed in the same way as in the conventional technique. For example, a high-temperature regenerated catalyst is fed into a heat extractor through a heat extracting tube, and then returned to a regenerator after heat exchanging and cooling, so as to adjust the temperature of the regenerated catalyst in the regenerator at 670-750° C. (670-700° C. for coke-burning regeneration, 700-750° C. for gasifying regeneration), and then the regenerated catalyst is fed into a riser reactor from the bottom thereof; or the high-temperature regenerated catalyst is divided into two parts to be returned to the reactor: one part is directly fed into the riser reactor from the bottom thereof without undergoing heat exchange, and contacts with the low-grade heavy oil feedstock; and the other part is fed into the heat extractor through the heat extracting tube to reduce its temperature by heat exchange, and then enters a fluidized bed reactor, which can provide a larger circulation volume of solid catalyst particles within the bed layer of the fluidized bed reactor as well as control the reaction temperature of the reactor, thereby achieving the control of reaction temperature under high catalyst-to-oil ratio conditions.

According to the method of the present invention, when heavy oil feedstock contacts and reacts with solid catalyst particles in a riser reactor, the catalyst-to-oil ratio is controlled at 7-10, and the contact reaction time is 0.5-1.5 seconds. The catalyst-to-oil ratio refers to mass ratio of solid catalyst particles to low-grade heavy oil feedstock. The catalyst-to-oil ratio and contact reaction time as selected above is more advantageous for completion of reaction of the feedstock oil in a short period of time.

According to the method of the present invention, the heavy oil feedstock is preheated to 220-300° C., and then is atomized and injected into the riser reactor by a feed nozzle provided at the lower portion of the riser reactor, where the heavy oil feedstock contacts and reacts with the solid catalyst particles. In a particular embodiment of the present invention, feed nozzles that are symmetrically distributed at the lower portion of the riser reactor may be used to inject the feedstock oil into the riser reactor.

According to the method of the present invention, the oil-gas stripped out by superheated steam from the coked solid catalyst particles that are separated from the produced oil-gas after the reaction is returned to a fractionation system, and the solid catalyst particles enter the regenerator for regeneration and the regenerated solid catalyst particles are recycled back to the riser reactor. Higher liquid product yield and higher quality oil product can be obtained after processing the above oil-gas, which is stripped out by superheated steam, by the fractionation system. For example, for gasoline fraction in the liquid product, the octane number can be 93 or more, much higher than that of coking gasoline, and meanwhile, the basic nitrogen compound content in the resultant wax oil fraction obtained is significantly reduced, which is only ⅔ of that of the coking wax oil.

According to the method of the present invention, a discharge port may be provided at the bottom of the regenerator according to the nature of low-grade heavy oil, and after regeneration, a part of the solid catalyst particles is discharged from the discharge port and sent to a heavy metal recovery process. After processing low-grade heavy oil according to the present invention, heavy metal content attached to the solid catalyst particles is high, metal components with high added value may be recovered by conventional alkaline leaching or acid leaching, etc. Particularly, the recovery may be conducted according to known methods.

For better understanding of the substance of the present invention, the present invention will be described in detail hereinafter with reference to specific embodiments, which should not be interpreted as limiting the scope of the present invention in any way.

As shown in FIG. 1, in an embodiment of the present invention, a riser-bed reactor with fluidized bed is used to process low-grade heavy oil. Specifically, the method includes: low-grade heavy oil 14 (various heavy oils having carbon residue content of greater than 15 wt %, heavy metal content of greater than 260 ng/g and relative density of higher than 0.985) is heated to 220-300° C. through a heating furnace 1, and then atomized by steam and injected into a riser reactor 2 by feed nozzles that are symmetrically and uniformly distributed along the circumference at lower portion of the riser reactor 2, where it contacts, mixes and reacts with high-temperature solid catalyst microsphere particles coming from a regenerator 8 (670-700° C. for coke-burning regeneration, and 700-750° C. for gasifying regeneration). The temperature in the reaction environment is controlled to be in the range of 550-610° C., the catalyst-to-oil ratio is controlled to be in the range of 7-10 and the reaction time is controlled to be in the range of 0.5-1.5 s, for example 1.0 s. The micro-activity index of the high-temperature solid catalyst microsphere particles is in the range of 20-50, preferably 20-40, for example 25.

The oil-gas initially produced in the above reaction continues to react with the solid catalyst particles after entering, via the riser reactor 2, a fluidized bed reactor 3 provided above and connected in series with the riser reactor 2. Since the diameter of the fluidized bed reactor 3 is larger than that of the riser reactor 2, the linear velocity will be reduced when entering the fluidized bed reactor 3 from the riser reactor 2, and thus the solid catalyst particles form a bed layer in the fluidized bed reactor 3. Here the reaction temperature is controlled to be in the range of 440-520° C., for example, 480° C., weight hourly space velocity is controlled to be in the range of 0.5-5 $h^{-1}$, for example 5 $h^{-1}$. Oil-gas which is continuously rising during reaction is sent to a settler 4 connected with the fluidized bed reactor 3 and, after the solid catalyst particles carried by the oil-gas being separated by two stages of cyclones 5 and 6, becomes oil-gas product 15, which leaves the settler 4 and enter a fractionation system (not shown).

High-temperature solid catalyst particles deposited with coke (spent catalyst) fall into a stripping section 7. Multi-layers of baffles are provided within the stripping section 7, and the spent catalyst is stripped in the stripping section 7 by superheated steam introduced from the bottom of a regenerator, so that oil-gas adsorbed onto the spent catalyst and oil-gas between the catalyst particles are replaced with water vapor and carried back to the upper portion of the stripping section 7, and then enter the fractionation system along with the oil-gas product produced by the reaction. The spent catalyst after being stripped enters the regenerator 8 via a standpipe 9 and plug valve 10 and is regenerated in the regenerator 8.

The main role of the regenerator 8 is to remove the coke on the solid catalyst particles formed during the reaction, and recover reactivity of the solid catalyst particles. The regeneration process includes introducing air 17 from the bottom of the regenerator 8 into a fluidized bed formed by the spent catalyst, regenerating the spent catalyst by coke-burning regeneration. The spent catalyst may also be regenerated by respectively introducing oxygen and water vapor into the regenerator through different pipelines at the bottom of the regenerator, and converting coke deposited on the spent catalyst into CO and $H_2$ by coke-burning reaction under high temperature conditions (e.g., 700-750° C.), so as to recover reactivity of the spent catalyst.

After separating entrained solid catalyst particles from regeneration flue gas 16 by a cyclone separation system 11, the regeneration flue gas 16 is discharged into the atmosphere. The regenerated high-temperature solid particles (regenerated catalyst) aretransported back to the riser reactor through a transfer pipeline (an inclined tube 13) and re-used.

Since the low-grade heavy oil to be processed has high coke yield and coke is produced in a high yield, resulting in surplus heat in the regenerator and the outputted regenerated catalyst having a very high temperature. Hence, in this embodiment, a heat extractor 12 is provided at a side of the regenerator, in order to maintain the temperature of the regenerator by adjusting surplus heat produced by coke burning (adjusting the returning temperature of the regenerated catalyst), wherein the heat extractor 12 uses water as heat exchange medium. As shown in FIG. 1, the high-temperature regenerated catalyst enters the heat extractor 12 through a heat extracting tube 18, returns to the regenerator 8 via an inclined tube 19 after heat exchange and cooling, so as to adjust the temperature of the regenerator 8 to 670-750° C.

Figure 2:
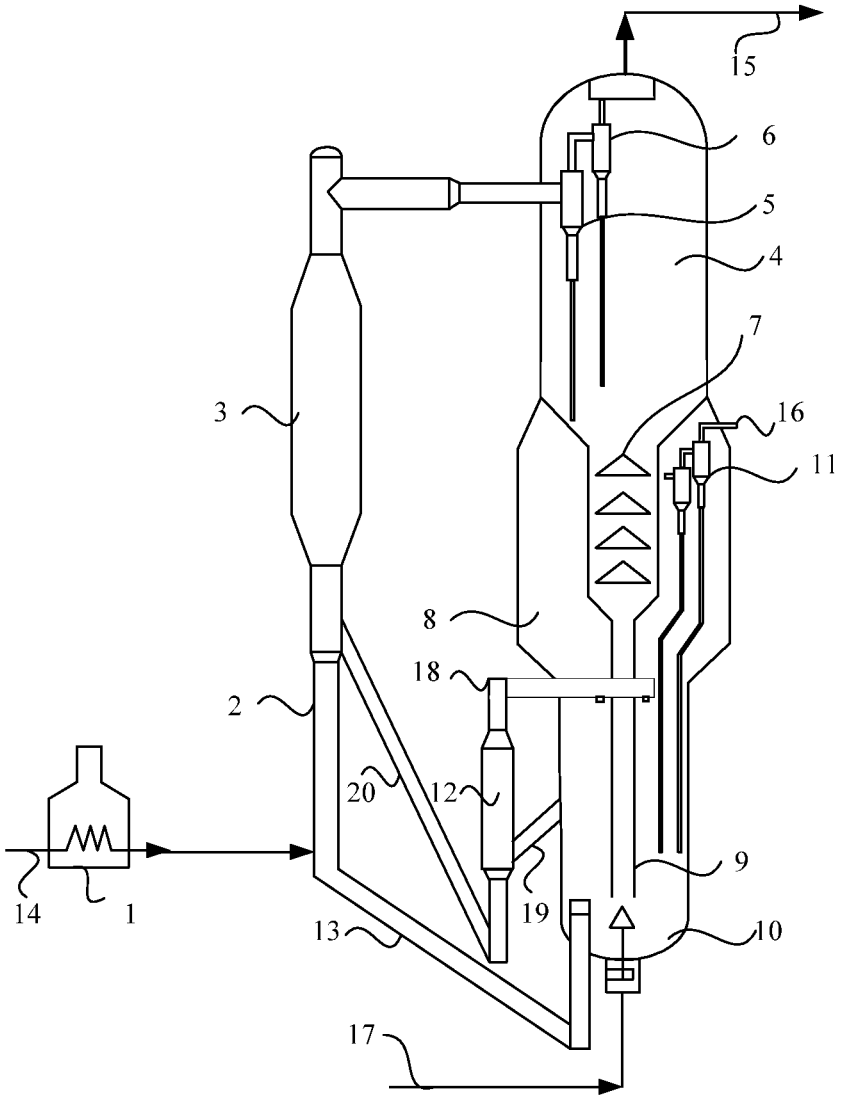

The heat extractor 12 also may be configured as shown in FIG. 2, the high-temperature regenerated catalyst is divided into two parts, one part is fed into the riser reactor 2 directly from the bottom thereof; and the other part is fed into the heat extractor 12 through the heat extracting tube 18 to reduce its temperature by heat exchange, and then enters the fluidized bed reactor 3, which can provide a larger circulation volume of catalyst particles within the bed layer as well as control the reaction temperature of the fluidized bed reactor, thereby achieving reaction temperature control under high catalyst-to-oil ratio conditions, and this part of the high-temperature regenerated catalyst then enters the fluidized bed reactor 3 via a inclined tube 20.

No matter whether a heat extractor is used or not, or no matter what kind of heat extracting method is adopted, the final control requirement is to make the regenerated catalyst returned to the riser reactor meet the requirement that the heavy oil feedstock can contact and react with the regenerated catalyst in the reactor at 550-610° C. (at predetermined catalyst-to-oil ratio).

After processing low-grade heavy oil by the method of this embodiment, (heavy) metal content cumulatively adhered to the solid catalyst particles is high, and thus during the production process, according to the adhesion situation of the heavy metal, a portion of the solid catalyst particles that have been fully regenerated in the regenerator is discharged from the system via a standpipe 21 for recycling the metal. The metal elements with high added value may be recovered by conventional alkaline leaching or acid leaching, etc. The specific recovery may be conducted according to known methods. Meanwhile, new solid catalyst particles are supplemented to maintain the production process, which can be fresh solid catalyst particles or the regenerated solid catalyst particles with metal recovered as described above.

When the method of the present invention is used to process, for example, low-grade heavy oil with carbon residue of 15-30%, the yield of liquid product can be 70 wt % or more, the yield of gas product can be equal to or less than 6 wt % and the yield of coke can be equal to or less than 20 wt %. In the upgraded low-grade heavy oil, removal rate of metal can be equal to or greater than 95 wt %, removal rate of asphaltene can be equal to or greater than 95 wt %, removal rate of carbon residue can be equal to or greater than 85 wt %. For gasoline fraction in the liquid product, the octane number can be 95 or more, much higher than the octane number, 40-50, of coking gasoline, thereby improving the quality of the light fraction product; and meanwhile, the basic nitrogen compound content in the resultant wax oil fraction is significantly reduced, which is only ⅔ of that of the coking wax oil. Compared with conventional low-grade heavy oil processes (e.g., fluidized coking and ROP processes), the product processed according to the method of the present invention has more advanced indexes, which can provide more and better lighter hydrocarbon materials for downstream processes, and additionally, for the design of the production process, the method of the present invention can process low-grade heavy oil in a one-step process.

Embodiment 1

To illustrate the effect of the method of the present invention, in this embodiment, the method as described above is used to process Venezuela vacuum residue. Solid catalyst particles are used as contacting catalyst, of which properties are shown in Table 2, and the properties of Venezuela vacuum residue are shown in Table 1.

Venezuela vacuum residue feedstock with carbon residue of 22.78 wt % is preheated to 260° C., and then introduced into a riser-bed reactor for processing. In this process, the control of the relevant parameters and material balance data are shown in Table 3.

The Venezuela vacuum residue feedstock is injected into the riser-bed reactor after preheated, to mix and react with the solid catalyst particles having efficient collaboration of good surface structure, fluidization performance, pore structure and suitable activity, making the feedstock undergo carbon residue removing, heavy metal removing and asphaltene removing reactions on surfaces of the contacting catalyst. Appropriately controlling reaction conditions during the reaction to keep liquid product yield at a high level, and meanwhile reduce gas product yield and coke yield to the greatest extent. In this embodiment, the oil-gas produced in the reaction undergoes a fractionation process, and a liquid product yield of 79.43%, a coke yield close to the carbon residue value of the feedstock, a removal rate of carbon residue of 89.16%, a removal rate of asphaltene of 95.28%, a removal rate of metal of 99.6%, a gasoline yield of 13.23%, and an octane number of 95.5 are achieved.

Further, in this embodiment, a heat extractor is also provided, the heat produced by coke burning during regeneration of the solid catalyst particles are carried by the regenerated catalyst and recycled into the riser reactor for reacting, and the surplus heat produced by coke burning may be adjusted by the heat extractor, so as to achieve heat balance between the reactor and the regenerator.

Comparative Embodiment 1

A ROP process is used to process Iran vacuum residue, properties of which are shown in Table 1. The properties of the inert solid catalyst particles (LTA1) used are shown in Table 2. Details for the method of this Comparative Embodiment can be found in Embodiment 1 of Chinese patent No. 200310110205.7, the content of which is incorporated herein by reference in its entirety.

Iran vacuum residue feedstock having carbon residue of 19.26 wt % is preheated to 220° C., and then introduced into a riser-bed reactor for processing. In this process, test conditions and material balance data are shown in Table 3. A liquid product yield of 77.36%, a coke yield close to the carbon residue in the feedstock, a removal rate of carbon residue of 75%, a removal rate of metal of more than 85%, and a gasoline yield of 6.02% are achieved.

TABLE 1

| Option | Embodiment 1 | Comparative Embodiment 1 |
|---|---|---|
| Type of low-grade heavy oil | Venezuela vacuum residue | Iran vacuum residue |
| Density (20° C.)/kg · $m^{-3}$ | 1038.8 | 1012.5 |
| Carbon residue, % | 22.78 | 19.26 |
| Molecular Weight | 952 | 816 |
| Viscosity (80° C.), $mm^2 \cdot s^{-1}$ | 7254 | 6015 |
| Elemental analysis, % | | |
| C/H | 83.78/9.66 | 85.56/10.83 |
| S/N | 4.30/0.66 | 2.8/0.53 |

TABLE 1-continued

| Option | Embodiment 1 | Comparative Embodiment 1 |
|---|---|---|
| Metal content/μg · $g^{-1}$ | | |
| Ni/V | 138.6/539.2 | 61.7/219.0 |
| Fe/Na | 22.6/24.4 | 17.5/1.3 |
| Component, wt % | | |
| Saturated hydrocarbon | 12.51 | 20.4 |
| Aromatic hydrocarbon | 42.69 | 50.7 |
| Gum | 33.56 | 28.9 |
| Asphaltene | 11.24 | |

TABLE 2

| Nature of catalyst | Embodiment 1 | Comparative Embodiment 1 |
|---|---|---|
| Micro-activity index | 25 | — |
| Physical properties | | |
| Bulk density, kg · $m^{-3}$ | 950 | 870 |
| Specific surface area, $m^2$ · $g^{-1}$ | 89.7 | 24.3 |
| Pore volume, ml · $g^{-1}$ | 0.215 | 0.08 |
| Abrasion index, wt % | 0.6 | 2.7 |
| Composition of screening | | |
| 0-20 um/20-40 um | 1.2/18.5 | 3.5/20.8 |
| 40-80 um/greater than 80 um | 45.8/34.5 | 51.9/23.8 |

TABLE 3

| Option | Embodiment 1 | Comparative Embodiment 1 |
|---|---|---|
| Reaction conditions in riser | | |
| Preheating temperature of feedstock, ° C. | 260 | 220 |
| Reactor outlet temperature, ° C. | / | 510 |
| Oil-catalyst mixing temperature, ° C. | 580 | / |
| Catalyst/feedstock, weight/weight | 7.0 | 9.2 |
| Reaction time, s | 1.0 | 1.5 |
| Bed reaction condition | | |
| Reactor outlet temperature, ° C. | 480 | / |
| Weight hourly space velocity, $h^{-1}$ | 5 | / |
| Regenerator temperature, ° C. | 690 | 700 |
| Distribution of main products | | |
| Cracked gas/gasoline | 4.78/13.23 | 6.20/6.02 |
| Diesel/greater than 350° C. heavy oil | 20.17/46.03 | 12.26/59.08 |
| Liquid product (gasoline + diesel + greater than 350° C. heavy oil) | | |
| Metal removal rate in liquid product, % | 99.60 | / |
| Carbon residue removal rate in liquid product, % | 89.16 | / |
| Asphaltene removal rate in liquid product, % | 95.28 | / |
| Coke/loss | 15.59/0.20 | 16.03/0.42 |

TABLE 4

| Option | Embodiment 1 | Comparative Embodiment 1 |
|---|---|---|
| Gasoline | | |
| Density (20° C.), kg · $m^{-3}$ | 792.9 | 784.9 |
| Octane number | 95.5 | / |

TABLE 4-continued

| Option | Embodiment 1 | Comparative Embodiment 1 |
|---|---|---|
| Sulfur, wt % | 0.30 | 0.32 |
| Nitrogen, μg · $g^{-1}$ | 200 | 120 |
| Distillation range, ° C. | | |
| IBP/10% | 36.4/64.0 | / |
| 30%/50% | 95.0/146.0 | / |
| 70%/90%/FBP | 166.0/191.0/210.8 | / |
| Diesel | | |
| Density (20° C.), kg · $m^{-3}$ | 918.3 | 908.8 |
| Viscosity (20° C.), $mm^2$/s | 4.43 | / |
| Sulfur, wt % | 0.88 | 0.5434 |
| Nitrogen, wt % | 0.23 | 0.1078 |
| Carbon, wt % | 88.32 | 87.65 |
| Hydrogen, wt % | 10.50 | 11.24 |
| Flash point, ° C. | 96 | / |
| Condensation point, ° C. | −30 | / |
| Distillation range, ° C. | | |
| IBP/10% | 164/208 | 215/246 |
| 30%/50% | 234/266 | —/277 |
| 70%/90%/FBP | 301/334/356 | —/317/325 |
| Heavy product | heavy oil | heavy oil |
| Density (20° C.), kg · $m^{-3}$ | 994.8 | 995.2 |
| Viscosity, $mm^2$/s | 86.12(50° C.) | 30.72(80° C.) |
| Sulfur, wt % | 1.99 | 2.32 |
| Basic nitrogen compound, μg · $g^{-1}$ | 413 | / |
| Total Nitrogen, wt % | 0.51 | 0.375 |
| Carbon residue, wt % | 2.53 | 9.0 |
| Flash point, ° C. | / | / |
| Condensation point, ° C. | / | / |
| Component, wt % | | |
| Saturated hydrocarbon | 42.2 | 46.4 |
| Aromatic hydrocarbon | 46.8 | 45.6 |
| Gum | 11.0 | 8.0 |
| Asphaltene | <0.1 | <0.1 |
| Distillation range, ° C. | | |
| IBP/10% | 346/360 | 311/346 |
| 30%/50% | 398/428 | —/462 |
| 70%/90%/FBP | 454/485/504 | 534/609/664(95%) |

It can be seen from the above embodiment and comparative embodiment, the method of the present invention can be used to process low-grade heavy oil having higher carbon residue, heavy metal, gum and asphaltene contents, so as to satisfy the requirements for the downstream processes; furthermore, product obtained according to the method of the present invention has higher liquid product yield and more advanced indexes, and can provide more and better lighter hydrocarbon materials for downstream processes.

Finally, it should be appreciated that: the above embodiments are only to illustrate the technical solutions of the present invention, but not intended to limit them; although the present invention has been described in detail with reference to the foregoing embodiments, an ordinarily skilled person in the art should understand that: it is still possible to modify the technical solutions described in these embodiments or equivalently replace some or all of the technical features in these embodiments; these modifications or replacements do not make the essence of the corresponding technical solutions depart from the scope of each technical solution of embodiments of the present invention.

What is claimed is:

1. A method for processing low-grade heavy oil with carbon residue content of greater than 15 wt %, heavy metal content of greater than 260 μg/g and relative density of more than 0.985, comprising:

providing a riser-bed reactor including a riser reactor and a fluidized bed reactor connected in series with the riser reactor;

preheating the low-grade heavy oil and injecting the preheated low-grade heavy oil into the riser reactor to contact and react with solid catalyst particles in the riser reactor, wherein reaction temperature in the riser reactor is controlled to be in the range of 550-610° C.;

introducing oil-gas that is formed after reaction with the solid catalyst particles in the riser reactor, from the riser reactor into the fluidized bed reactor to continue to react in the fluidized bed reactor, wherein reaction temperature in a bed layer of the fluidized bed reactor is 440-520° C. and weight hourly space velocity is 0.5-5 $h^{-1}$; and separating oil-gas that is formed after reaction in the fluidized bed reactor, from coked solid catalyst particles carried therein, and introducing the separated oil-gas into a fractionation system;

wherein the solid catalyst particles have a specific surface area of greater than 80 $m^2 \cdot g^{-1}$ and not more than 89.7 $m^2 \cdot g^{-1}$, a pore volume of greater than 0.22 ml/g, a wear index of less than 2.0%, a bulk density of 0.7-1.50 $g/cm^3$, a matrix density of 1.8-2.8 $g/cm^3$ and a micro-activity index of 20-25, and the solid catalyst particles are made of a porous material, in which pores with a diameter of 10 nm or more account for 60% or more in the pore size distribution of the porous material, and wherein when the low-grade heavy oil contacts and reacts with the solid catalyst particles in the riser reactor, a catalyst-to-oil ratio is controlled at 7-10, and reaction time is 0.5-1.5 seconds.

2. The method according to claim 1, wherein the low-grade heavy oil is preheated to 220-300° C. before being introduced into the riser reactor.

3. The method according to claim 1, wherein the coked solid catalyst particles separated from the oil-gas enter a regenerator after being stripped by superheated steam for regeneration, and then are recycled to the riser-bed reactor.

4. The method according to claim 2, wherein the coked solid catalyst particles separated from the oil-gas enter a regenerator after being stripped by superheated steam for regeneration, and then are recycled to the riser-bed reactor.

5. The method according to claim 3, wherein, after regeneration, the coked solid catalyst particles are introduced into a heat extractor and recycled back to the riser reactor from a bottom thereof after heat exchange by the heat extractor, and temperature of the regenerated solid catalyst particles recycled to the riser reactor is kept at the range of 670-750° C.

6. The method according to claim 4, wherein, after regeneration, the coked solid catalyst particles are introduced into a heat extractor and recycled back to the riser reactor from a bottom thereof after heat exchange by the heat extractor, and temperature of the regenerated solid catalyst particles recycled to the riser reactor is kept at the range of 670-750° C.

7. The method according to claim 3, wherein, after regeneration, one part of the coked solid catalyst particles is returned to the riser reactor from a bottom portion thereof, and another part of the coked solid catalyst particles passes through a heat extractor for heat exchange and then is fed into the fluidized bed reactor.

8. The method according to claim 4, wherein, after regeneration, one part of the coked solid catalyst particles is returned to the riser reactor from a bottom portion thereof, and another part of the coked solid catalyst particles passes through a heat extractor for heat exchange and then is fed into the fluidized bed reactor.

9. The method according to claim 3, wherein the regeneration of the coked solid catalyst particles comprises coke-burning regeneration of the coked solid catalyst particles, or introducing oxygen and water vapor to regenerate the coked solid catalyst particles, and the regenerated solid catalyst particles are recycled to the riser reactor.

10. The method according to claim 4, wherein the regeneration of the coked solid catalyst particles comprises coke-burning regeneration of the coked solid catalyst particles, or introducing oxygen and water vapor to regenerate the coked solid catalyst particles, and the regenerated solid catalyst particles are recycled to the riser reactor.

11. The method according to claim 3, wherein oil-gas stripped out by superheated steam from the coked solid catalyst particles separated from the oil-gas is sent to the fractionation system, and the coked solid catalyst particles enter the regenerator for regeneration and regenerated solid catalyst particles are recycled back to the riser-bed reactor.

12. The method according to claim 4, wherein oil-gas stripped out by superheated steam from the coked solid catalyst particles separated from the oil-gas is sent to the fractionation system, and the coked solid catalyst particles enter the regenerator for regeneration and regenerated solid catalyst particles are recycled back to the riser-bed reactor.

13. The method according to claim 3, wherein a discharge port is provided at a bottom of the regenerator, and a part of the coked solid catalyst particles after being regenerated is discharged from the discharge port and sent to a heavy metal recovery process.

14. The method according to claim 4, wherein a discharge port is provided at a bottom of the regenerator, and a part of the coked solid catalyst particles after being regenerated is discharged from the discharge port and sent to a heavy metal recovery process.

* * * * *